US009623271B2

(12) United States Patent
McLoughlin et al.

(10) Patent No.: US 9,623,271 B2
(45) Date of Patent: Apr. 18, 2017

(54) FIRE HOSE DEPLOYMENT DEVICE

(75) Inventors: John E. McLoughlin, Hauppauge, NY (US); Neocles G. Athanasiades, E. Setauket, NY (US); Kiam Meng Toh, St. James, NY (US)

(73) Assignee: ROM Acquisition Corporation, Belton, MO (US)

( * ) Notice: Subject to any disclaimer, the term of this patent is extended or adjusted under 35 U.S.C. 154(b) by 1215 days.

(21) Appl. No.: 13/230,402

(22) Filed: Sep. 12, 2011

(65) Prior Publication Data

US 2012/0285706 A1 Nov. 15, 2012

Related U.S. Application Data

(63) Continuation-in-part of application No. 13/104,330, filed on May 10, 2011.

(51) Int. Cl.
*A62C 27/00* (2006.01)
*A62C 33/04* (2006.01)

(52) U.S. Cl.
CPC ..... *A62C 33/04* (2013.01); *A62C 27/00* (2013.01)

(58) Field of Classification Search
USPC ..... 169/52, 24, 60, 61; 239/146, 172, 197, 239/198
See application file for complete search history.

(56) References Cited

U.S. PATENT DOCUMENTS

| | | | | |
|---|---|---|---|---|
| 3,693,884 | A | 9/1972 | Snodgrass | |
| 3,724,554 | A | 4/1973 | Rupert | |
| 4,817,653 | A | 4/1989 | Krajicek | |
| 5,249,631 | A | 10/1993 | Ferren | |
| 5,860,479 | A | 1/1999 | LaFollette | |
| 6,186,166 | B1 * | 2/2001 | Myers | 137/355.16 |
| 6,283,220 | B1 * | 9/2001 | Carter | 169/24 |
| 7,264,062 | B1 | 9/2007 | Ham | |
| 7,503,338 | B2 | 3/2009 | Harrington | |
| 7,631,700 | B1 | 12/2009 | Gil | |
| 2006/0185858 | A1 | 8/2006 | Baba | |
| 2010/0032491 | A1 | 2/2010 | Lozier | |
| 2010/0038100 | A1 * | 2/2010 | Schuetzle | 169/52 |
| 2010/0044058 | A1 | 2/2010 | Cummins | |
| 2010/0163256 | A1 | 7/2010 | Williams | |
| 2010/0218960 | A1 * | 9/2010 | Dillman et al. | 169/45 |

OTHER PUBLICATIONS

Akron Brass Company, SaberMaster Master Stream Nozzles, www.akronbrass.com, pp. 32-35, Wooster, Ohio, USA.

* cited by examiner

*Primary Examiner* — Davis Hwu
(74) *Attorney, Agent, or Firm* — Wei Wei Jeang; Grable Martin Fulton PLLC

(57) ABSTRACT

A fire hose deployment device for a firefighting robotic vehicle comprises a wagon body having a bottom and two generally vertical sides, a front tongue coupled to the wagon body and hitched to a rear hitch of the robotic vehicle. The wagon body has left and right wheels coupled to the wagon near the rear of the wagon body, and the wagon body carries a fire hose with a first end coupled to a nozzle on the robotic vehicle and a second end coupled to a fluid source.

16 Claims, 3 Drawing Sheets

FIRE HOSE DEPLOYMENT DEVICE

FIELD

The present disclosure relates to a fire hose deployment device for a firefighting robotic vehicle.

BACKGROUND

Firefighting is a highly dangerous task that subjects firefighters to many hazards, such as toxic smoke and fumes, high intensity heat, obstructed paths, collapsing structures, and falling objects. Fighting wild brush or forest fires presents yet another set of difficulties and challenges. To minimize risks to human lives, robotic vehicles have been envisioned as firefighting vehicles that can be remotely controlled and sent into hazardous situations to put out fires or perform other related tasks.

SUMMARY

A fire hose deployment device for a firefighting robotic vehicle is envisioned.

A fire hose deployment device for a firefighting robotic vehicle comprises a wagon body having a bottom and two generally vertical sides, a front tongue coupled to the wagon body and hitched to a rear hitch of the robotic vehicle. The wagon body has left and right wheels coupled to the wagon near the rear of the wagon body, and the wagon body carries a fire hose with a first end coupled to a nozzle on the robotic vehicle and a second end coupled to a fluid source.

A fire hose deployment wagon comprises a body, a front tongue hitched to a rear hitch of a firefighting robotic vehicle, and left and right wheels coupled to the body near the rear of the body. The wagon body accommodates a fire hose arranged orderly therein having a first end coupled to a master stream nozzle coupled to the firefighting robotic vehicle and a second end coupled to a fluid source.

A remote firefighting device comprises a robotic vehicle and a hose deployment wagon. The robotic vehicle comprises a master stream nozzle and a rear hitch. The fire hose deployment wagon comprises a body, a front tongue hitched to a rear hitch of the firefighting robotic vehicle, and left and right wheels coupled to the body near the rear of the body. The wagon body accommodates a fire hose arranged orderly therein having a first end coupled to a master stream nozzle coupled to the firefighting robotic vehicle and a second end coupled to a fluid source.

DETAILED DESCRIPTION

Figure 1:
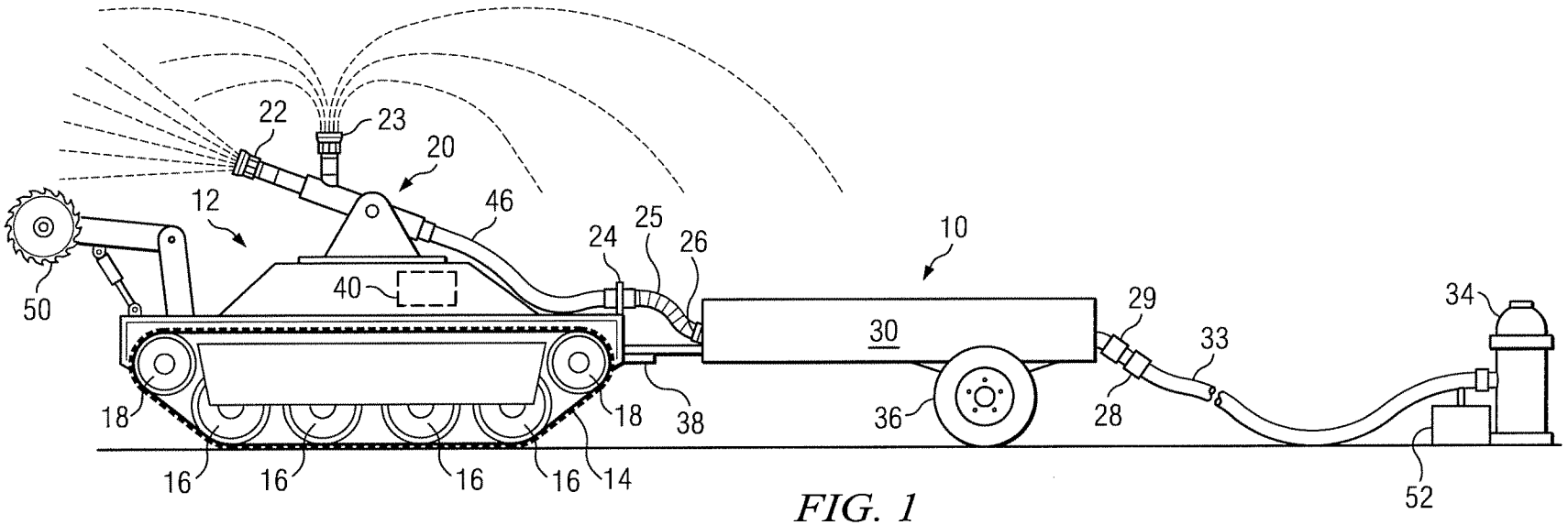
FIG. 1 is a side elevational view of an exemplary embodiment of a fire hose deployment device for a firefighting robotic vehicle.
Figure 2:
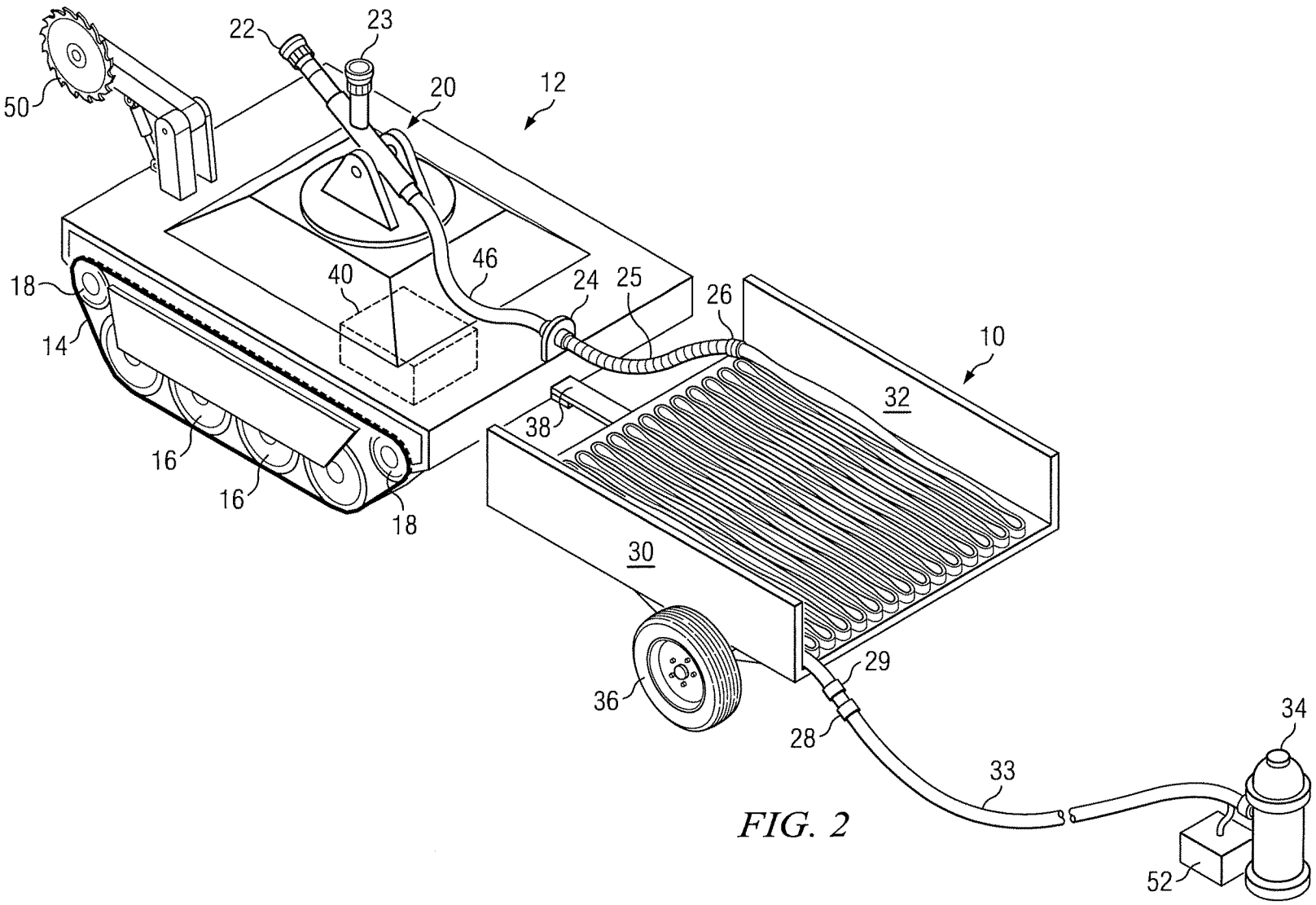
FIG. 2 is a perspective view of an exemplary embodiment of a fire hose deployment device for a firefighting robotic vehicle.

FIGS. 1 and 2 are side elevational and perspective views of an exemplary embodiment of a fire hose deployment device 10 for a firefighting robotic vehicle 12. The robotic vehicle 12 includes a self-propelling system (not shown) powered by gas, diesel, electricity, or another form of energy that enables the robotic vehicle to travel and function according to remote control commands. Accordingly, the robotic vehicle 12 may include a fuel tank or batteries for power source. As shown, the robotic vehicle 12 is equipped with an undercarriage having a left and right track assemblies 14 and respective wheels 16 and sprockets 18. The track assemblies 14 enable the robotic vehicle 12 to travel on rugged terrain and over obstacles. The tracks may be constructed of metal or other suitable materials. The robotic vehicle 12 may turn, reverse, and proceed by operating the track assemblies 14.

Figure 3:
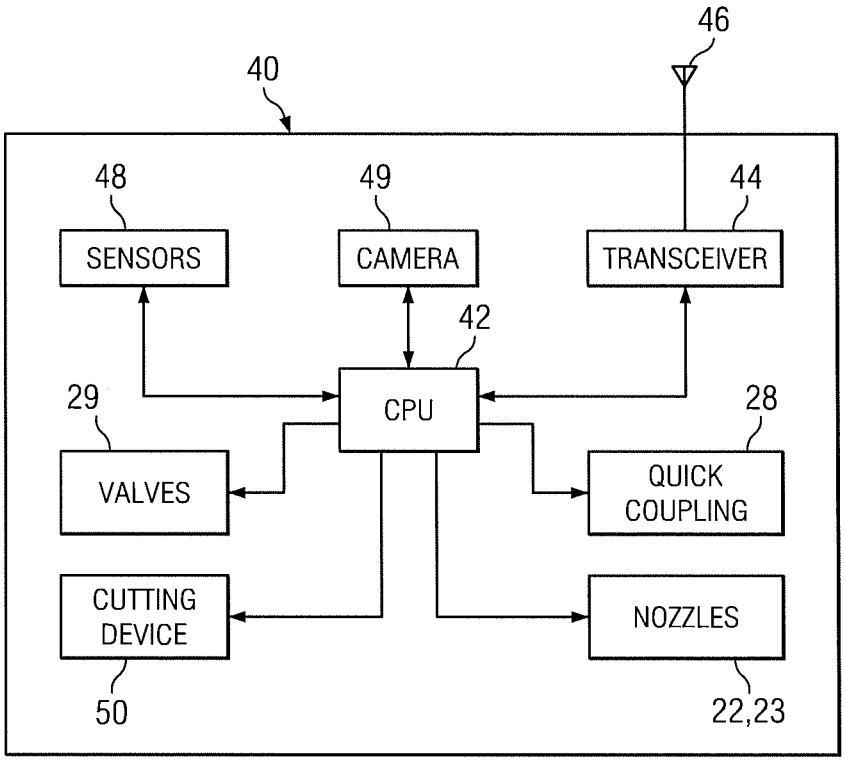
FIG. 3 is a simplified block diagram of an exemplary embodiment of an electronic control circuitry.

FIG. 3 is a simplified block diagram of an exemplary embodiment of an electronic control circuitry 40 disposed within the robotic vehicle 12. The robotic vehicle 12 is equipped with a computer such as a CPU (central processor unit), microprocessor or microcontroller 42 executing software code and coupled to a communications interface such as a transceiver 44 and an antenna 46 that are operable to receive remote radio control signals from a remote controller (not shown) operated by a firefighter at a command post, for example. Alternatively, the robotic vehicle 12 may utilize wired communication with the controller/user. The electronic control circuitry 40 further includes a number of environmental and operation sensors 48 that measure various operating condition and environment parameters such as ambient temperature, water pressure, flammable, hazardous, and/or toxic chemicals and gases, radiation, etc. These environmental and operating parameters measured by the sensors 48 are transmitted or relayed (wirelessly and/or via wired communication) to the remote controller or command post to inform the firefighters of the current conditions at the site. Therefore, the robotic vehicle 12 may function as an advance team sent ahead of the firefighters to a site. Only if the environment is safe for humans, as detected by the sensors 48 on the robotic vehicle 12, are firefighters permitted to venture to the site. The electronic control circuitry 40 may further include a video camera 49 that may capture and feed video data and/or infrared video data to the firefighters located at the command post wirelessly via the CPU 42, transceiver 44, and antenna 46, and/or via wired communications.

The robotic vehicle 12 further includes a turret 20 coupled to a nozzle 22, which is preferably a master stream nozzle. A second nozzle 23, is coupled to the same water source as the master stream nozzle 22. The turret 20 is preferably operable to pivot vertically with an 180 degree range, and to rotate horizontally with an 360 degree range, so that the master stream nozzle 22 can be easily manipulated to accurately direct a liquid at the fire. The master stream nozzle 22 is a multi-purpose nozzle that may be remotely controlled to release water, fog, and foam in a number of flow configurations and pressures. For example, the master stream nozzle 22 may switch from a straight stream to fog, to a piercing nozzle. The master stream nozzle 22 may be further configured to enable a water-powered drill (not shown). The master stream nozzle 22 is primarily used to extinguish fires forward of the robotic vehicle 12 while the second nozzle 23 is primarily used to spray water on the robotic vehicle 12 and the deployment device 10 for cooling purposes.

The master stream nozzle 22 is further coupled to a hose coupling 24 which enables it to be connected to a first hose segment 25. The first hose segment 25 is a section of hose that is flexible and does not kink easily. The hose segment 25 is coupled to a lengthy segment of flat fire hose 27 via an adaptor 26. The fire hose 27 is carried in a hose deployment device 10 generally in the form of a cart or wagon with a generally flat bottom, two generally vertical sides 30 and 32, and a tongue 38 coupled to a hitch of the robotic vehicle 12. The wagon body is preferably constructed of sturdy and fire retardant materials such as metal, composites, and other suitable materials. As shown in FIG. 2, the fire hose 27 is laid flat in the body of the wagon in an orderly manner with the other end coupled to an automatic coupling 28 that may be remotely controlled to decouple or disconnect either wirelessly via the transceiver 44, antenna 46, or via wired communications. Alternatively, the fire hose 27 may be arranged around a fire hose reel. The fire hose 27 may also be in rolls interconnected from roll to roll, each roll being pulled off in turn as the hose wagon proceeds stretching the rolls out before deploying the next roll. In this manner, the hose deployment device 10 and robotic vehicle 12 may be quickly moved or recalled without pulling the long length of fire hose behind it. Further coupled to the hose 27 is a remotely controllable drain valve 29 that may operate to drain the water accumulated in the hose segments. The hose 27 may also be equipped with a relief valve 31 that may be manually set to a water pressure to ensure a safe working pressure in the system. A fluid (water or chemical) source 34, such as a hydrant, tank, or pump is coupled to the hose 27 via another segment of hose 33. The lengths of the hoses 27 and 33 are largely dependent on the desired distance to be traveled by the robotic vehicle 12. To facilitate the deployment of the fire hose 27, the front and back of the wagon are preferably open. The top of the wagon body may be open to facilitate the loading of the hose into the wagon, or a hinged lid (not shown) may be used to keep debris and objects from falling on the hose. The weight of the wagon and the fire hose 27 is supported by two tires or wheels 36 positioned near the rear of the wagon so that the combined weight impinges downwardly on the tongue and hitch to provide additional traction to the robotic vehicle track assemblies 14 on the ground.

In operation, as the robotic vehicle 12 travels away from the fluid source 34, the hose 27 deploys and is released from the wagon in an orderly manner. When the robotic vehicle reaches the limit of travel generally determined by the length of the fire hose 27, the controller may remotely operate the turret 20 and the master stream nozzle 22 to direct and dispense water and/or a chemical solution in a variety of pressures and configurations as needed. The flexible hose segment 25 is adapted to maintain the passageway of the fire hose without kinks or bends even while the robotic vehicle and the wagon are oriented at odd angles. This prevents the obstruction of the flow of the water or chemicals in the fire hoses 27 and 33.

The robotic vehicle 12 may additionally be equipped with a cutting tool 50, such as a circular saw, for example, that may be used to cut and remove obstacles or other materials. The cutting tool 50 may be controlled via remote control by the firefighters located at the command post via the CPU 42, transceiver 44, and antenna 46.

As shown in FIG. 1, an air supply 52 mounted near the water source 34 may be used to couple and supply air into the hoses 27 and 33 to quickly evacuate the water accumulated in the system for ease of moving the vehicle and wagon.

The features of the present invention which are believed to be novel are set forth below with particularity in the appended claims. However, modifications, variations, and changes to the exemplary embodiments described above will be apparent to those skilled in the art, and the fire hose deployment device described herein thus encompasses such modifications, variations, and changes and are not limited to the specific embodiments described herein.

What is claimed is:

1. A fire hose deployment device for a firefighting robotic vehicle comprising:

a wagon body having a bottom and two generally vertical sides;

a front tongue coupled to the wagon body and hitched to a rear hitch of the robotic vehicle;

left and right wheels coupled to the wagon; and the wagon body carrying a fire hose with a first end coupled to a nozzle on the robotic vehicle and a second end coupled to a generally stationary fluid source, the fire hose being laid and arranged accordion-style on the bottom of the wagon body, and as the robotic vehicle and the wagon travel away from the fluid source to a site of the fire, the fire hose being automatically and orderly unfolded and deployed from the wagon, enabling the robotic vehicle and wagon to reach the fire site while still being coupled to the fluid source to conduct fluid from the fluid source to be applied by the nozzle of the robotic vehicle to extinguish the fire.

2. The hose deployment device of claim 1 wherein the wagon body comprises open front and back ends.

3. The hose deployment device of claim 1 wherein the wagon body comprises a lid covering the top of the wagon body.

4. A fire hose deployment wagon comprising:

a body;

a front tongue hitched to a rear hitch of a remote-controlled vehicle;

left and right wheels coupled to the body near the rear of the body;

the body accommodating a fire hose arranged orderly therein having a first end coupled to a master stream nozzle and a second end coupled to a generally stationary fluid source, the fire hose being laid and folded on the bottom of the wagon body, and as the remote-controlled vehicle and the wagon travel away from the fluid source to a site of the fire, the fire hose being automatically deployed from the wagon, enabling the remote-controlled vehicle and wagon to reach the fire site while still being coupled to the fluid source to conduct fluid from the fluid source to be applied by the master stream nozzle to extinguish the fire.

5. The fire hose deployment wagon of claim 4, wherein the body further comprises left and right generally vertical sides.

6. A remote firefighting device, comprising:

a remotely-controllable wagon;

a master stream nozzle;

left and right wheels coupled to the wagon;

the wagon accommodating a fire hose arranged orderly therein having a first end coupled to the master stream nozzle and a second end coupled to a generally stationary fluid source, the fire hose being laid and arranged accordion-style on the bottom of the wagon, and as the remotely-controlled wagon travel away from the fluid source to a site of the fire, the fire hose being automatically and orderly unfolded and deployed from the wagon, enabling the remotely-controlled wagon to reach the fire site while still being coupled to the fluid source to conduct fluid from the fluid source to be applied by the master stream nozzle to extinguish the fire.

7. The remote firefighting device of claim 6, wherein the further comprises left and right generally vertical sides, and open front and back ends.

8. The remote firefighting device of claim 6, wherein the wagon further comprises a lid covering the top of the wagon.

9. The remote firefighting device of claim 6, wherein the remotely-controlled wagon further comprises a control circuit including:

a CPU;

a radio signal transceiver coupled to the CPU;

an antenna coupled to the radio signal transceiver;

a plurality of sensors coupled to the CPU and operable to measure a plurality of environmental and operating condition parameters.

10. The remote firefighting device of claim 6, wherein the remotely-controlled wagon further comprises a remotely-controlled second nozzle operable to spray a liquid on the wagon for cooling purposes.

11. The remote firefighting device of claim 6, wherein the remotely-controlled wagon further comprises a remotely-controlled cutting element.

12. The remote firefighting device of claim 6, wherein the remotely-controlled wagon further comprises a video camera.

13. The remote firefighting device of claim 6, wherein the fire hose comprises a remotely-controlled drain valve.

14. The remote firefighting device of claim 6, wherein the fire hose comprises a relief valve.

15. The remote firefighting device of claim 6, wherein the fire hose comprises a remotely-controlled quick coupling.

16. The remote firefighting device of claim 6, further comprising an air supply operable to quickly evacuate fluids accumulated in the hose.

* * * * *